US006443218B1

(12) United States Patent
Hörnschemeyer

(10) Patent No.: US 6,443,218 B1
(45) Date of Patent: Sep. 3, 2002

(54) TUBULAR MOLD

(75) Inventor: Wolfgang Hörnschemeyer, Osnabrück (DE)

(73) Assignee: KM Europa Metal AG, Osnabruck (DE)

( * ) Notice: Subject to any disclaimer, the term of this patent is extended or adjusted under 35 U.S.C. 154(b) by 0 days.

(21) Appl. No.: 09/468,675

(22) Filed: Dec. 21, 1999

(30) Foreign Application Priority Data

Dec. 21, 1998 (DE) ..... 198 59 040

(51) Int. Cl.[7] ..... B22D 11/04
(52) U.S. Cl. ..... 164/418; 164/459
(58) Field of Search ..... 164/418, 435, 164/459

(56) References Cited

U.S. PATENT DOCUMENTS 3,416,222 A * 12/1968 Pearson ..... 29/527.7
3,910,342 A * 10/1975 Johnson ..... 164/418
4,207,941 A * 6/1980 Shurm ..... 164/484
4,565,236 A * 1/1986 Masui et al. ..... 164/459
4,658,884 A * 4/1987 Euler et al. ..... 164/443
4,714,103 A * 12/1987 Polick et al. ..... 164/486
4,799,533 A * 1/1989 Ahrens et al. ..... 164/137
4,805,685 A * 2/1989 Lorento ..... 164/418
5,036,902 A * 8/1991 Streubel et al. ..... 164/491
5,360,053 A * 11/1994 Kawa et al. ..... 164/418
5,615,731 A * 4/1997 Roehrig et al. ..... 164/418

FOREIGN PATENT DOCUMENTS

JP 60083743 A * 5/1985 ..... B22D/11/04

* cited by examiner

*Primary Examiner*—M. Alexandra Elve
*Assistant Examiner*—Kevin P. Kerns
(74) *Attorney, Agent, or Firm*—Kenyon & Kenyon

(57) ABSTRACT

An outer peripheral groove is provided at a distance from the top front end of the tube wall of a tubular mold. Into this peripheral groove grip, from opposing sides, U-shaped flanges having inner latching segments are inserted. The radial extension of the latching segments is smaller than the depth of the peripheral groove. Provided adjacently to the top front end is a circumferential recess, on which a reinforcement frame, which is able to be screw-coupled to the flanges and which braces against the flange of the water tank, and which can be located in position with an exact fit, while being sealed off. When the tubular mold is recalibrated, in particular using the explosive reforming method, the wall thickness is reduced, so that it is then necessary to rework the recess. One merely needs to put a new reinforcement frame in place and screw it tightly in place via the flanges.

4 Claims, 2 Drawing Sheets

TUBULAR MOLD

BACKGROUND OF THE INVENTION

The present invention is directed to a tubular mold, which can be positionally fixed at a top end in a water tight manner within a water tank, as well as a method for recalibrating a tubular mold that has already been in use.

It is generally known that tubular molds used for continuous casting are positionally fixed in an impervious manner in water tanks used for cooling. To withstand the high cooling-water pressures, the tubular molds are reinforced at their upper ends, to enable them to retain their inherent stability. In this connection, it is generally known, especially when working with "beam-blank" or "dog-bone" molds having a double T-shaped cross-section, to weld wedges (i.e., splines) into the mutually opposing outer channels at the upper ends, to provide tubular molds of this kind with a substantially rectangular cross-section (as seen via a frontal view).

In recalibrating these types of tubular molds, using the explosive reforming method (Accumold method), the use of welded-in wedges has proven, however, to be a hindrance during the reforming process. In addition, the welded seams sometimes tear apart, resulting in an imperfect seal. Furthermore, it became apparent that it was impossible or very difficult to recalibrate the original form at the upper end of the tubular molds.

SUMMARY OF THE INVENTION

The present invention first provides a tubular mold that can be positionally fixed, in a reliably impervious and form-stabilized manner, in a water tank. Second, to provide a method for recalibrating a tubular mold which has already been in use, the invention provides a method which allows the tubular mold to be repeatedly reworked without causing sealing problems or mold material damage.

According to the invention, an outer peripheral groove having, in particular, a rectangular cross-section, is provided at a distance from the top front end of the tube wall of a tubular mold. Furthermore, a circumferential recess is formed adjacently to the top front end of the tubular mold. This recess is used to ensure that the reinforcement frame, which supports itself on the flange of the water tank as well, is sealingly located in position with an exact fit. The reinforcement frame is also sealed off from the water tank. Disposed underneath the reinforcement frame are two U-shaped flanges having inner latching segments, which grip from opposing sides into the peripheral groove on the tube wall.

The radial extension of the latching segments is smaller than the depth of the peripheral groove. Once the U-shaped flanges are positionally oriented with the aid of the latching segments in the peripheral groove, the reinforcement frame is slid onto the recess and then securely fastened by screws to the two U-shaped flanges. In this way, the top end of the tubular mold is provided with sufficient dimensional shape stability with respect to cooling-water pressures. This obviates the need for welding, thereby eliminating the danger of damage to the mold material.

If a tubular mold that has already been in use requires recalibration, one merely needs to remove the reinforcement frame and the U-shaped flanges. This makes it possible to restore the inner mold cavity, so that it meets the continuous casting requirements. Once the mold cavity has been restored, which, as a rule, is associated with a reduction in wall thickness at the top end of the tubular mold, the recess is merely reworked in conformance with the reduced wall thickness. A new reinforcement frame, adapted thereto, is then put in place and screwed to the remaining U-shaped flanges. These flanges can remain because the radial extent of the latching segments is smaller than the depth of the peripheral groove.

The fact that this calibration process can be repeated numerous times and that merely the appropriate reinforcement frames need to be provided is quite beneficial.

In accordance with one advantageous specific embodiment, the inner rim of the reinforcement frame facing the deepest part of the recess is provided with a hollow recess to accommodate a sealing ring. This sealing ring is pressed into the corner region of the recess when the reinforcement frame is screw-mounted on the U-shaped flanges, thereby ensuring the sealing action.

The features of the invention can be applied quite advantageously to a tubular mold configured with a double-T shape, as is generally known, for example, in the form of a "beam-blank" or a "dog-bone" mold. It is also within the scope of this invention that it be applied with billet and bloom shapes.

All known methods can be used to restore the inner mold cavity of a tubular mold. Particularly advantageous, however, is the explosive reforming method, in which a mandrel is introduced into the tubular mold. Once the inner mold cavity is restored, the recess at the top end of the tubular mold is advantageously reworked in a milling operation.

BRIEF DESCRIPTION OF THE DRAWINGS

The present invention is further described below with reference to an embodiment constructed according to the principles of the invention, in which.

DETAILED DESCRIPTION OF THE INVENTION

Figure 2:
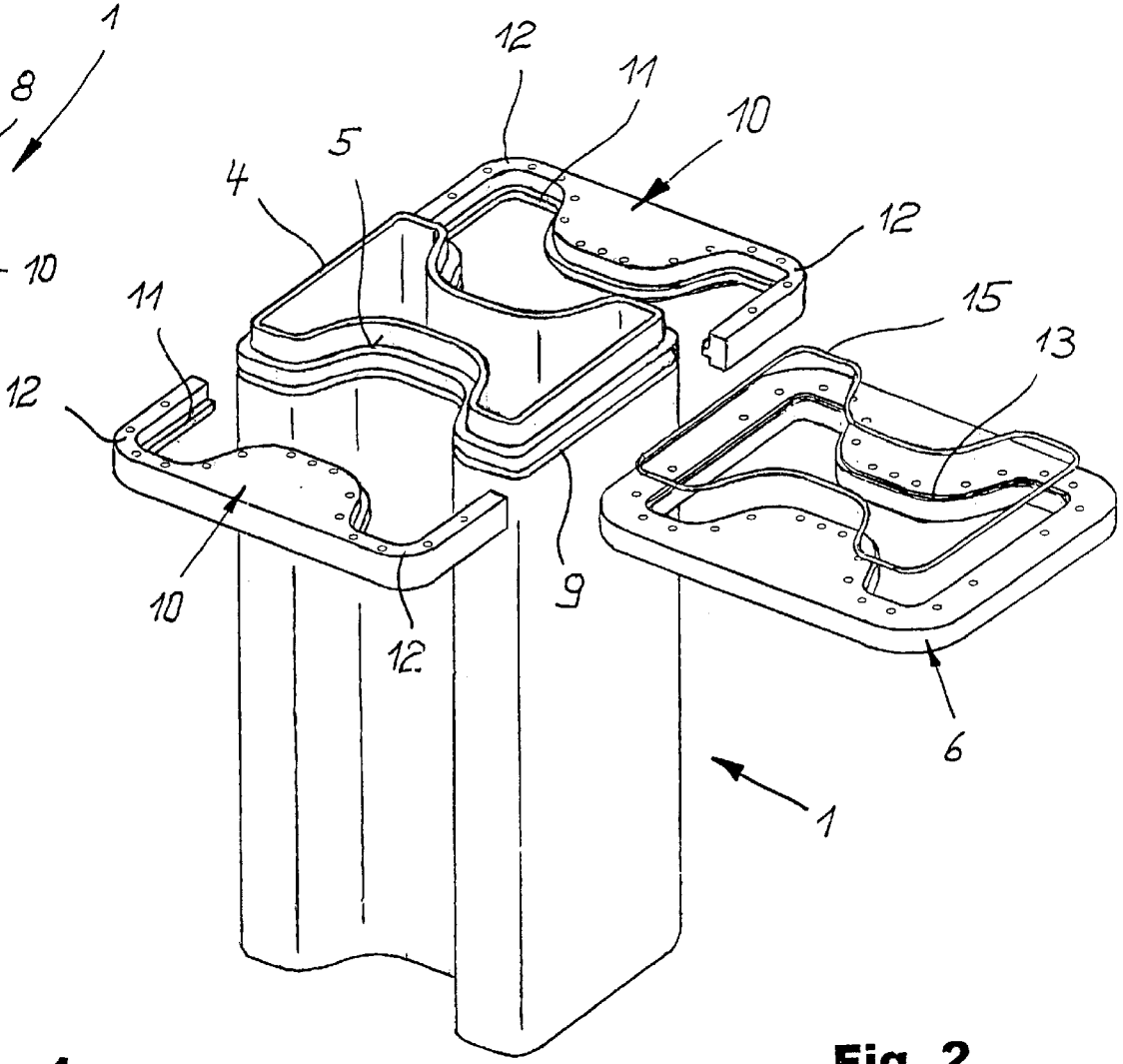
FIG. 2 is a perspective, exploded view of the top end of the tubular mold of FIG. 1 in an exploded view.
Figure 1:
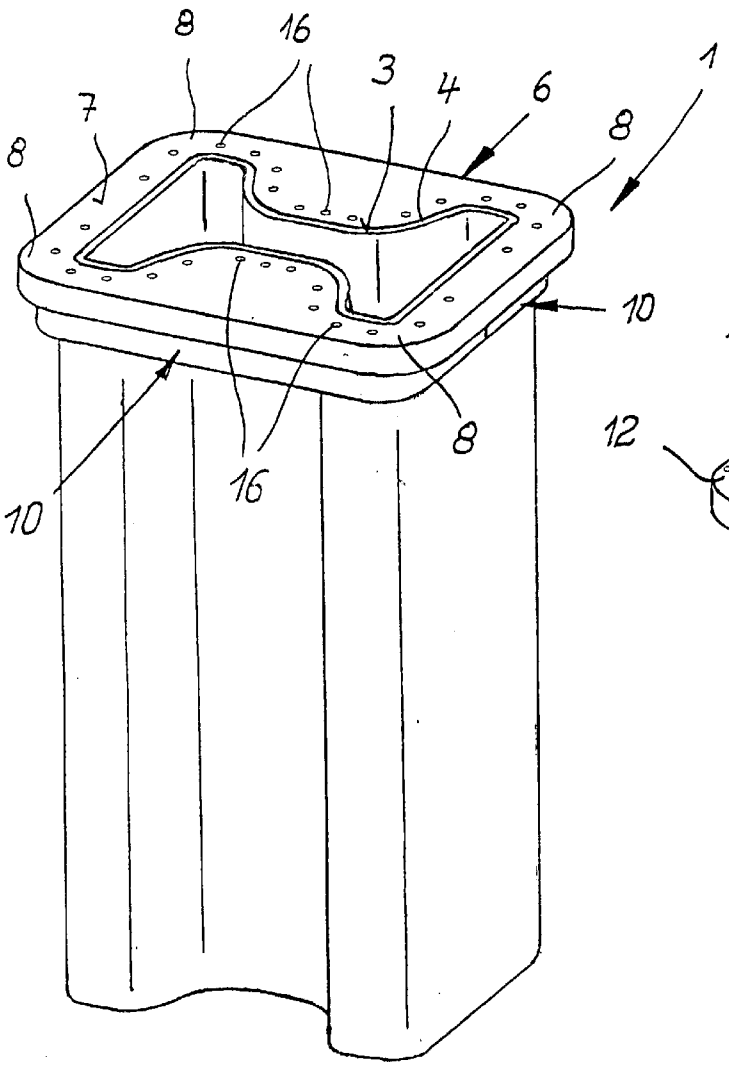
FIG. 1 is a perspective view of the top end of a "beam-blank" tubular mold
Figure 3:
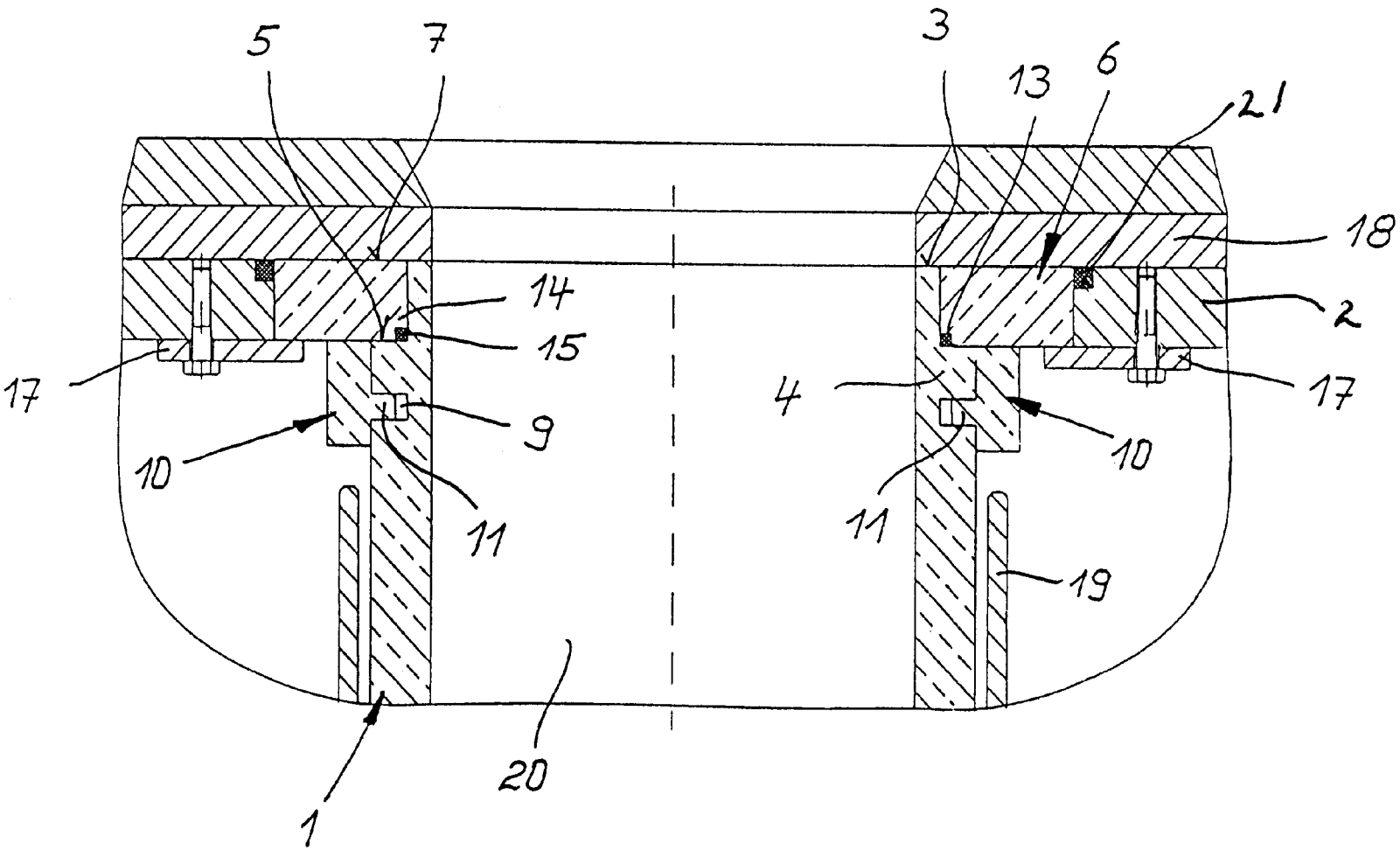
FIG. 3 is an enlarged, vertically cross-sectioned view of the top end of the tubular mold of FIG. 1 shown in an installed state.

In FIGS. 1 through 3, numeral 1 denotes a tubular mold made of copper and having a double T-shaped cross section. A tubular mold 1 of this kind is also referred to as a a "beam-blank" mold.

To positionally fix (FIG. 3) a tubular mold 1 of this kind in an impervious and dimensionally stable manner in a water tank 2 (not shown in greater detail), a peripheral-side recess 5 having a rectangular cross-section is provided adjacent to the top front end 3 of tube wall 4. This recess 5 accommodates a reinforcement frame 6, whose top side 7 runs coplanar with the front end 3 of the tube wall 4. Reinforcement frame 6 has an essentially rectangular outer contour, with rounded corner regions 8. FIG. 2 shows reinforcement frame 6, flipped over by 180°.

Below recess 5, at a distance roughly corresponding to the vertical extension of recess 5, an outer peripheral groove 9 having a rectangular cross-section is provided in tube wall 4. Peripheral groove 9 accommodates inner latching segments 11 formed on two U-shaped flanges 10. The radial extension of latching segments 11 is smaller than the depth of peripheral groove 9. Corner regions 12 of flanges 10 are also rounded.

Once latching segments 11 have been pushed into peripheral groove 9, reinforcement frame 6, together with sealing ring 15 embedded in groove 13 in the region of inner rim 14, is placed upon recess 5 and subsequently set tightly with flanges 10 by a plurality of screw bolts 16, extending along the contour of tubular mold 1.

Reinforcement frame 6 is underpinned by retaining plates 17, which are screw-coupled to water tank 2. A seal 21 at the flange 18 between reinforcement frame 6 and water tank 2 is used to seal off above-lying flange 18 of water tank 2.

In the embodiment shown in FIG. 3, a water cooling jacket 19 is employed.

Recalibrating a tubular mold 1 requires disassembling it, and then removing reinforcement frame 6, as well as flanges 10. Tubular mold 1 is then calibrated using the explosive reforming method by introducing a mandrel (not shown in greater detail) into mold cavity 20. This explosive reforming process reduces the thickness of tube wall 4 in the upper region. On the basis of this reduction, recess 5 is subsequently reworked accordingly, in particular, re-cut (i.e., re-milled). Peripheral groove 9 does not need to be reworked, since its depth is greater than the radial extension of latching segments 11. Once recess 5 is reworked, a new reinforcement frame 6, adapted thereto, is mounted and set tightly with flanges 10.

Given a roughly 0.7 mm reduction in wall thickness per calibration, a tubular mold 1 can be recalibrated about three times.

What is claimed is:

1. A tubular mold having a top end that is positionally fixed in a water-tight manner within a watertank, comprising:

a tube wall having a top front end, the tube wall having a circumferential recess adjacent the top front end, and an outer peripheral groove having a depth, the groove being located at a distance from the top front end and circumferential recess of the tube wall;

a plurality of U-shaped flanges, the flanges having inner latching segments configured for gripping insertion into the peripheral groove, each of the inner latching segments having a radial extension smaller than the depth of the peripheral groove; and a reinforcement frame at least partly located in the circumferential recess, the frame being screw-couplable and adjacent to the U-shaped flanges and bracing against flanges of the water tank, the frame being locatable in position with an exact fit, while being sealed off from the tube wall, as well as from the flange of the water tank, wherein the tube wall is thereby stabilized against pressures exerted by cooling water.

2. The tubular mold as recited in claim 1, wherein the reinforcement frame has an inner rim, part of which faces the groove and which is provided with a hollow recess to accommodate a sealing ring.

3. The tubular mold as recited in claim 1, wherein the mold has a double-T shape.

4. The tubular mold as recited in claim 2, wherein the mold has a double-T shape.

* * * * *